US010851561B2

(12) United States Patent
Valentine

(10) Patent No.: US 10,851,561 B2
(45) Date of Patent: Dec. 1, 2020

(54) STRUCTURAL FOOTER

(71) Applicant: ARV Ventures, LLC, Delta, OH (US)

(72) Inventor: Aaron Valentine, Delta, OH (US)

(73) Assignee: ARV VENTURES, LLC, Delta, OH (US)

( * ) Notice: Subject to any disclaimer, the term of this patent is extended or adjusted under 35 U.S.C. 154(b) by 0 days.

(21) Appl. No.: 16/665,758

(22) Filed: Oct. 28, 2019

(65) Prior Publication Data

US 2020/0131799 A1 Apr. 30, 2020

Related U.S. Application Data

(60) Provisional application No. 62/750,882, filed on Oct. 26, 2018, provisional application No. 62/846,189, filed on May 10, 2019.

(51) Int. Cl.

| | |
|---|---|
| ***E04H 17/22*** | (2006.01) |
| ***E04B 1/30*** | (2006.01) |
| ***E04B 1/18*** | (2006.01) |
| *E04H 17/14* | (2006.01) |

(52) U.S. Cl.

CPC ..... *E04H 17/22* (2013.01); *E04B 1/185* (2013.01); *E04B 1/30* (2013.01); *E04H 17/1413* (2013.01)

(58) Field of Classification Search

CPC . E04H 17/22; E04H 17/1413; E04H 17/1417; E04H 17/265; E04H 12/22; E04H 12/2215; E04H 12/223; E04H 12/2238; E04H 12/2246; E04H 12/2253; E04H 12/2261; E04H 12/2269; E04H 12/2292; E04H 12/347; E04B 1/185; E04B 1/30; E02D 27/42; E02D 5/60; E02D 5/80; A63B 71/028

USPC ..... 52/165, 169.13, 170, 298, 835; 248/156, 248/545, 530; 256/65.14

See application file for complete search history.

(56) References Cited

U.S. PATENT DOCUMENTS

| | | | | | |
|---|---|---|---|---|---|
| 212,868 | A | | 3/1879 | Palmer | |
| 427,815 | A | * | 5/1890 | Wolf | E04H 12/2215 52/165 |
| 574,641 | A | * | 1/1897 | Streator | E04H 12/2292 52/302.5 |
| 772,928 | A | * | 10/1904 | Dunlap | E04H 12/2269 52/298 |
| 817,738 | A | | 4/1906 | Kaufman | |
| 894,794 | A | * | 7/1908 | Hufford | E04H 12/2261 52/296 |
| 982,380 | A | * | 1/1911 | Martin | E04H 12/2292 52/170 |
| 1,230,475 | A | * | 6/1917 | Gardner | E02D 5/30 405/257 |
| 1,263,098 | A | | 4/1918 | Morris | |
| 1,321,237 | A | * | 11/1919 | Newman | E04H 12/2261 52/296 |

(Continued)

*Primary Examiner* — Kyle J. Walraed-Sullivan

(74) *Attorney, Agent, or Firm* — Michael E. Dockins; Shumaker, Loop Kendrick, LLP

(57) ABSTRACT

A post assembly includes an elongate first portion having a upper first end and an opposing lower second end. The first portion configured for supporting a structure. The post assembly also includes a second portion formed from a non-deteriorating material coupled to the second end of the first portion. A coupling device couples the first portion to the second portion.

19 Claims, 3 Drawing Sheets

(56) References Cited

U.S. PATENT DOCUMENTS 1,329,026 A * 1/1920 Snyder ..... E04H 12/22 52/170
3,736,759 A * 6/1973 Blose ..... E02D 5/60 405/216
4,199,908 A * 4/1980 Teeters ..... E04H 12/2284 248/357
4,279,107 A * 7/1981 Bollmann ..... E02D 27/42 403/86
4,306,821 A * 12/1981 Moore ..... E02D 5/64 405/211
4,644,713 A * 2/1987 Lehman ..... E04H 12/2215 52/165
4,650,367 A * 3/1987 Dietzler ..... E02B 11/00 405/43
4,702,057 A * 10/1987 Phillips ..... E04H 12/2292 52/514
4,790,533 A * 12/1988 Potthast, Sr. ..... E04H 12/2215 173/90
4,862,992 A * 9/1989 Melfi ..... E01F 8/0023 181/210
4,924,648 A * 5/1990 Gilb ..... E04B 1/41 52/295
5,090,165 A 2/1992 Kenny
5,315,796 A * 5/1994 Gruhlke ..... E04H 12/2269 52/169.13
5,355,642 A * 10/1994 Palamarz ..... E04B 1/41 256/65.14
5,425,593 A * 6/1995 Buehler ..... E01F 9/685 403/305
5,571,229 A * 11/1996 Fitzsimmons ..... A63B 71/023 248/156
5,622,356 A * 4/1997 Duggan ..... E04H 12/2292 256/1
5,625,988 A * 5/1997 Killick ..... E04H 12/2269 248/156
5,720,134 A 2/1998 Kurtz
5,740,645 A * 4/1998 Raby ..... E02D 27/42 248/346.5
5,782,040 A * 7/1998 McCartan ..... E01F 9/635 345/690
5,782,443 A * 7/1998 La Fontaine ..... A63B 55/10 248/156
5,884,874 A * 3/1999 Speece ..... E04H 12/2215 248/156
6,073,416 A * 6/2000 Peter ..... E04H 12/2292 248/519
6,098,351 A * 8/2000 Mills ..... E04H 12/2292 52/169.14
6,176,062 B1 * 1/2001 Fayle ..... E01F 15/0469 405/216
6,389,760 B1 * 5/2002 McDonnell ..... A63B 71/028 248/156
6,886,296 B1 * 5/2005 John ..... E02D 5/60 248/519
7,004,683 B1 * 2/2006 Rupiper ..... E02D 5/56 405/229
D521,656 S * 5/2006 Terrels ..... D25/122
7,627,995 B1 * 12/2009 Yoder ..... E04H 12/2253 248/519
7,721,490 B1 * 5/2010 Cerula ..... E04H 12/2253 52/169.9
7,779,589 B2 * 8/2010 Salman ..... E04H 12/2269 52/298
8,474,221 B1 * 7/2013 Ceko ..... E04H 12/182 52/843
8,572,905 B1 * 11/2013 Driggers ..... E02D 27/12 52/169.13
8,782,978 B1 * 7/2014 Frenette ..... E04H 12/2269 248/519
8,875,469 B1 * 11/2014 Keller, Sr. ..... E02D 5/60 52/745.12
8,959,857 B1 * 2/2015 Lin ..... E04H 12/2261 256/65.14
9,394,717 B2 * 7/2016 Paananen ..... E04H 12/2284
9,909,271 B2 * 3/2018 Wiegel ..... E01F 15/003
10,227,786 B2 * 3/2019 Pantelides ..... E01D 22/00
10,246,944 B1 * 4/2019 Powers, III ..... E21B 7/24
2001/0000548 A1 * 5/2001 Niehaus ..... E04H 12/2292 29/450
2002/0066247 A1 * 6/2002 Leek ..... E04B 1/2604 52/295
2005/0005540 A1 * 1/2005 Nesbitt ..... E04H 12/2292 52/169.9
2005/0246977 A1 * 11/2005 MacMillan ..... E04H 12/2269 52/169.9
2005/0252124 A1 * 11/2005 Bergman ..... E04H 12/2253 52/296
2005/0274938 A1 * 12/2005 Nesbitt ..... E04H 12/2292 256/1
2005/0279896 A1 * 12/2005 Callies ..... E04H 12/2269 248/218.4
2005/0279897 A1 * 12/2005 Callies ..... A47K 1/00 248/218.4
2006/0186392 A1 * 8/2006 Keller ..... E04H 12/2292 256/59
2007/0245645 A1 * 10/2007 Nesbitt ..... E04H 12/2292 52/169.9
2007/0267552 A1 * 11/2007 Meyer ..... E04H 12/2261 248/156
2008/0104899 A1 * 5/2008 Hill ..... E04H 12/2269 52/165
2008/0237561 A1 * 10/2008 Cozby ..... E06B 11/04 256/73
2009/0133337 A1 * 5/2009 Hill ..... E04H 12/2215 52/165
2010/0071315 A1 * 3/2010 Hong ..... E04C 3/293 52/848
2010/0083547 A1 4/2010 Cowen
2010/0230652 A1 * 9/2010 Calton ..... E01F 15/0484 256/65.1
2011/0036026 A1 * 2/2011 Lee ..... E04H 12/2223 52/157
2011/0113686 A1 * 5/2011 Morgan ..... E02D 5/805 47/47
2012/0192507 A1 * 8/2012 Paananen ..... E04H 17/22 52/155
2013/0160380 A1 * 6/2013 Atchley ..... E04H 12/2223 52/157
2013/0263532 A1 * 10/2013 Dabkowski ..... E04H 12/2284 52/165
2013/0284995 A1 * 10/2013 Myer ..... E04H 17/22 256/19
2014/0076243 A1 * 3/2014 Barzani ..... A01K 15/027 119/416
2014/0105686 A1 * 4/2014 Southworth ..... B65D 90/046 405/107
2014/0373461 A1 * 12/2014 Rodriguez ..... E04H 12/2215 52/170
2014/0373471 A1 * 12/2014 Knepp ..... E04C 3/34 52/296
2015/0090857 A1 * 4/2015 Walker ..... E04H 12/347 248/535
2015/0204044 A1 * 7/2015 Botrie ..... C08G 18/4804 52/292
2015/0225919 A1 * 8/2015 Wagler ..... E02D 27/42 52/166
2015/0247336 A1 * 9/2015 Bergman ..... E02D 27/42 52/157
2015/0259943 A1 * 9/2015 Paananen ..... E04H 12/2284 52/159
2016/0047137 A1 * 2/2016 Aagerup ..... E02D 27/12 248/530
2017/0335590 A1 * 11/2017 Volin ..... E04H 12/2215
2018/0230708 A1 * 8/2018 Hanson ..... E04H 12/02
2019/0063102 A1 * 2/2019 Writesman ..... E01F 9/642
2019/0063104 A1 * 2/2019 Johnson ..... E01F 9/608
2019/0085589 A1 * 3/2019 McKinney ..... E04H 17/1426

(56) References Cited

U.S. PATENT DOCUMENTS

| | | | | |
|---|---|---|---|---|
| 2019/0226232 | A1* | 7/2019 | Goodin | E04H 17/163 |
| 2019/0301195 | A1* | 10/2019 | Dalton | E04H 17/1421 |
| 2019/0376308 | A1* | 12/2019 | Tersigni | E04H 12/2292 |
| 2020/0018086 | A1* | 1/2020 | Durrant | E04H 12/2292 |
| 2020/0056338 | A1* | 2/2020 | Coglitore | G09F 15/0037 |
| 2020/0157832 | A1* | 5/2020 | Van Hoek-Patterson | E04H 12/2292 |

* cited by examiner

STRUCTURAL FOOTER

CROSS-REFERENCE TO RELATED PATENT APPLICATION

This patent application claims priority to U.S. Provisional Patent Application Ser. No. 62/750,882 filed on Oct. 26, 2018 and U.S. Provisional Patent Application Ser. No. 62/846,189 filed on May 10, 2019, the entire disclosures of which are hereby incorporated herein by reference.

FIELD OF THE INVENTION

The invention relates to fence posts, and more particularly to bases for fence posts.

BACKGROUND

As known, wood post or poles are typically employed for forming fences such as wood fences, wire fences, or chain-linked fences. Wood posts are also employed for alternate purposes such as for displaying signage, hanging utility lines or wires, or for general construction purposes. Wood posts typically degrade, rot, wear, or otherwise breakdown or fail structurally faster than other types of posts. The degradation is a result of weather, sun, moisture, exploitation to other harsh parameters and elements.

Replacing or repairing the posts, particularly for residential and lightweight commercial applications, can be time consuming, laborious, expensive, and/or ergonomically undesired. Typically, the post must be dug up to remove the post which is laborious and may also result in damage to landscaping. In order to prolong the lifespan of the posts, other types of posts or solutions may be employed. However, the solutions may be expensive, may not maintain an aesthetic or authentic appeal, may be more complex, or may be less sturdy or durable.

Therefore, it is desirable to provide a structurally stable post assembly including a base portion and a wooden portion, wherein the base portion prolongs longevity, is eco-friendly, maintains aesthetic appeal, minimizes costs, and is easily coupled to the wooden portion.

SUMMARY

In accordance and attuned with the present disclosure, a structurally stable post assembly including a base portion and a wooden portion, wherein the base portion prolongs longevity, is eco-friendly, maintains aesthetic appeal, minimizes costs, and is easily coupled to the wooden portion has been surprisingly discovered.

According to a first embodiment of the disclosure a post assembly is disclosed. The post assembly includes a post assembly including an elongate first portion having a upper first end and an opposing lower second end. The first portion configured for supporting a structure. The post assembly also includes a second portion formed from a non-deteriorating material coupled to the second end of the first portion. A coupling device couples the first portion to the second portion.

According to another embodiment of the disclosure, a post assembly includes an elongate upper portion having a upper first end and an opposing lower second end. The upper portion is exposed from the ground. A base portion formed from a non-deteriorating material is removeably coupled to the second end of the upper portion. At least a portion of the base portion is disposed in the ground. An insert couples the upper portion to the base portion.

According to yet another embodiment of the disclosure, a method for installing a post assembly in a ground is disclosed. The method includes the steps of forming a hole in the ground, providing a receptacle formed from a plastic, positioning a plurality of inserts in the receptacle and embedding the plurality of inserts into the receptacle with a plastic foam. The plastic foam and the receptacle forms a base portion of the post assembly. The method also includes the steps of providing an upper portion to be coupled with the base portion of the post assembly, forming bores in the upper portion aligning with the plurality of inserts extending from the base portion, and placing the upper portion against the base portion.

BRIEF DESCRIPTION OF THE DRAWINGS

The above, as well as other advantages of the present invention, will become readily apparent to those skilled in the art from the following detailed description of a preferred embodiment when considered in the light of the accompanying photographs.

DETAILED DESCRIPTION OF EXEMPLARY EMBODIMENTS OF THE INVENTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

"A" and "an" as used herein indicate "at least one" of the item is present; a plurality of such items may be present, when possible. As used herein, "substantially" means "to a considerable degree," "largely," or "proximately" as a person skilled in the art in view of the instant disclosure would understand the term. Spatially relative terms, such as "front," "back," "inner," "outer," "bottom," "top," "horizontal," "vertical," "upper," "lower," "side," "up," "down," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
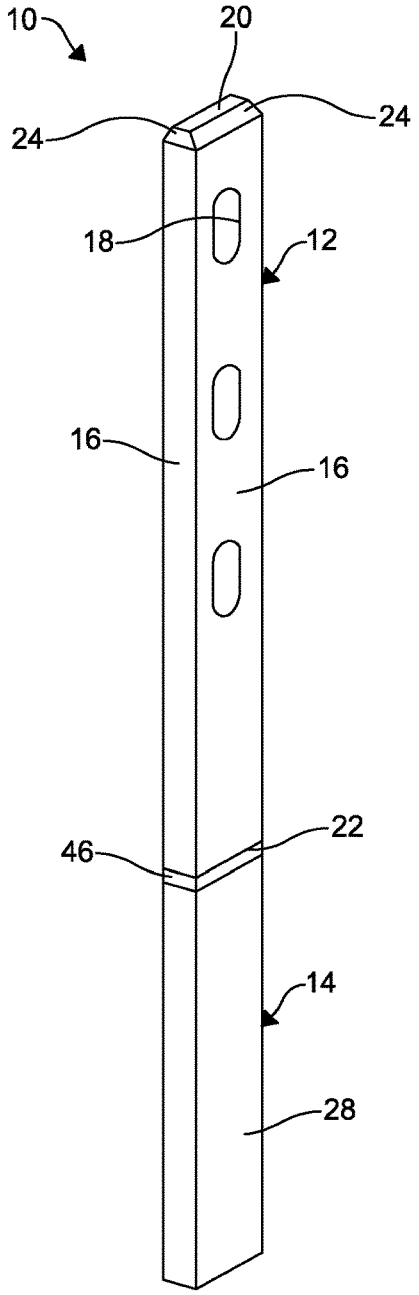
FIG. 1 is a front perspective view of a post assembly according to an embodiment of the present disclosure.
Figure 2:
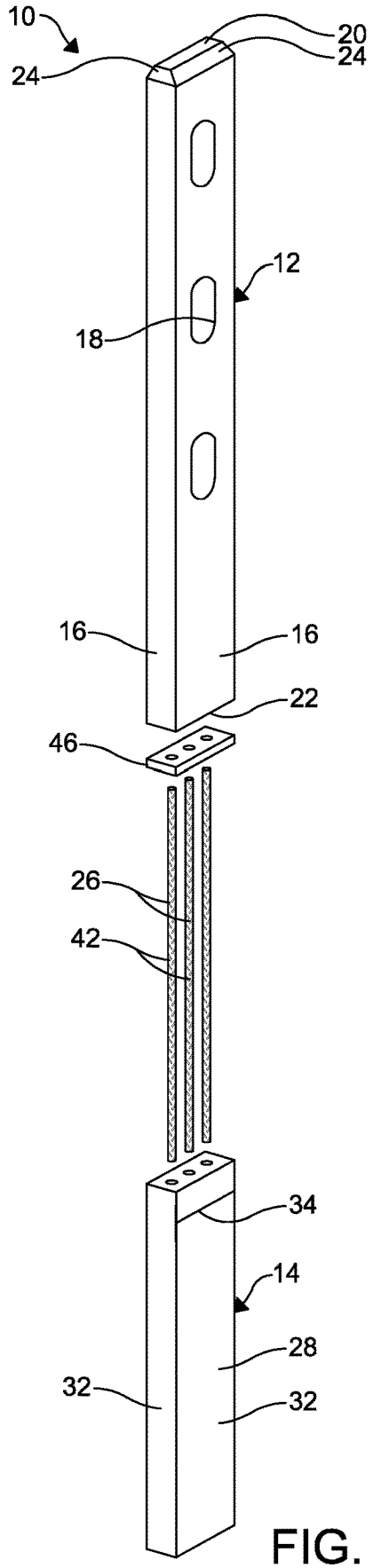
FIG. 2 is a an exploded view of the post assembly of FIG. 1.
Figure 3:
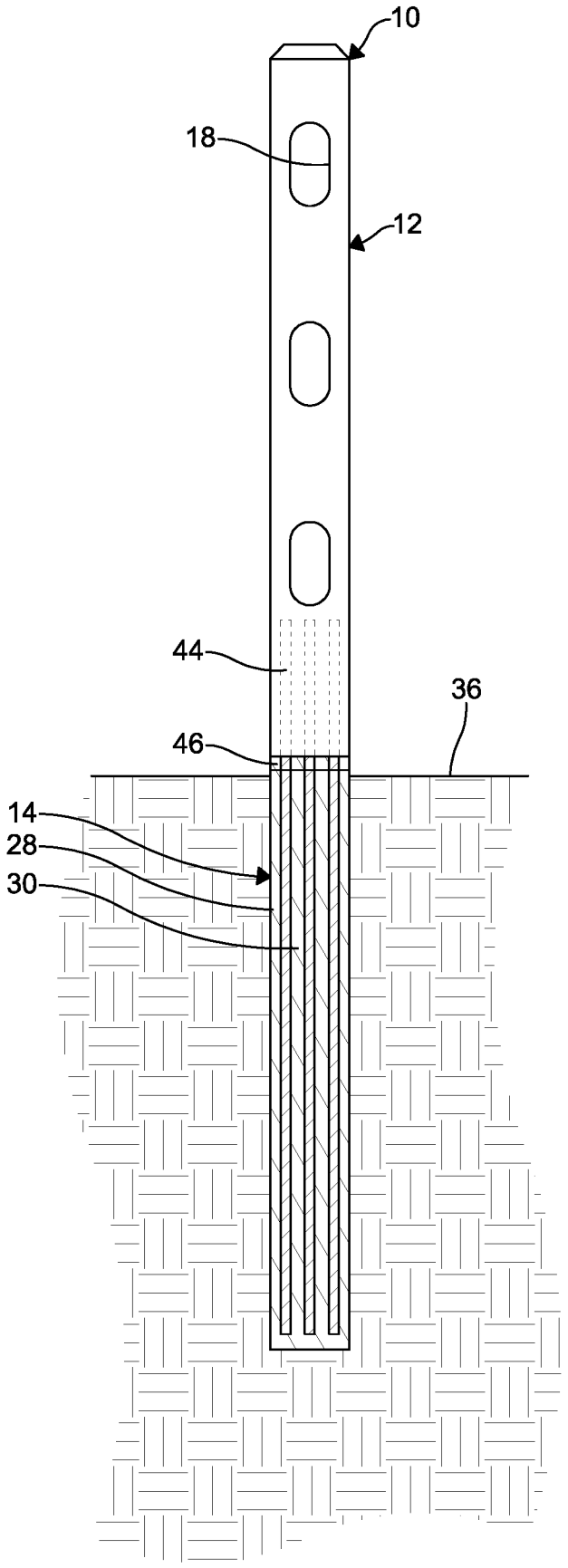
FIG. 3 is a cross-sectional view of the post assembly of FIGS. 1-2 disposed in a ground.
Figure 4:
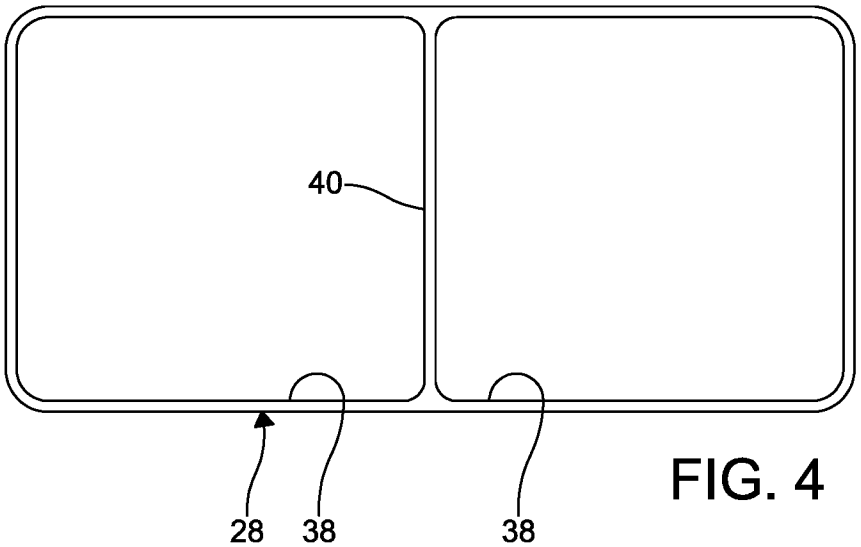
FIG. 4 is a cross-sectional top plan view of a receptacle of the post assembly of FIGS. 1-3.

FIGS. 1-4 illustrate a post assembly 10 according an embodiment of the disclosure. In the embodiment illustrated, the post assembly 10 is configured for a fence assembly such as split-fence assembly. However, it is understood, the post assembly 10 can be for any type of fence assembly, mounting structures or objects, or for building purposes. The post assembly 10 is configured to support other structures and/or objects.

The post assembly 10 includes an upper first portion 12 and a second portion or base 14 coupled to the first portion 12. The first portion 12 is formed from a wood material or wood composition. The wood material is a treated wood material, wherein the wood is treated with preservative chemicals or compositions. For example, the wood material is 0.40 alkaline copper quaternary (ACQ) wood material that is not kiln dried after a treatment thereof. However, it is understood the upper first portion 12 can be formed from other materials without departing of the scope of the present disclosure. In the embodiment illustrated the first portion 12 is elongate and has a plurality of sides 16, such as four, for example, forming a rectangular cross-sectional shape. However, it is understood the first portion 12 can have any number of sides forming other cross-sectional shapes such as triangular, hexagonal, any other polygonal shape as desired. Additionally, the sides 16 can form a L-shaped cross-sectional shaped, a V-shaped cross-section shape, a T-shaped cross-sectional shape, or any other angled cross-sectional shape. In another example, the first portion 12 can have one continuous side forming a circular, ovular, or other curvilinear shapes. The first potion 12 has a substantially constant width and length along a height of the first portion 12. However, the width and length can vary along a height of the first portion 12 if desired. Where the first portion 12 has a curvilinear cross-sectional shape, the diameter or radius thereof can be constant or vary along a height of the first portion 12.

In the embodiment illustrated, the post assembly 10 is configured to receive a plurality of cross-members (not shown) to form a section of a fence. The first portion 12 includes a plurality of slots 18 for receiving the cross-members. While not illustrated, the first portion 12 can include other features depending on the shape or type of the post assembly 10 being employed. For example, the first portion 12 can include brackets, slots, holes, frames, couplers, etc. for supporting other objects or structure, as desired.

The first portion 12 includes an upper first end 20 opposing a lower second end 22. The first end 20 has chamfered edges 24. Although, the edges can be filleted if desired. The second end 22 is coupled to the base 14 by a coupling device 26 which will be describe din more detail hereinbelow.

The base 14 includes a receptacle 28 for containing a filler 30. The receptacle 28 is hollow and is formed from a heavy duty, non-deteriorating, and ultraviolet (UV) ray resistant plastic material. For example, the material the base 14 is formed from is a thermoplastic polymer or plastic material such as a high-density polyethylene (HDPE) plastic resin, for example. In another example, the base 14 is formed from a polycarbonate (PC) plastic, other types of polyethylene (PE) materials, a polyethylene terephthalate (PET) plastic, polyvinyl chloride (PVC), any other plastic material, or combinations thereof. In yet another example, the receptacle 28 can be formed from a metal that is minimally susceptible to rusting such as aluminium, brass, galvanized steel, or any other durable metal as desired.

In the embodiment illustrated, the base 14 is elongate and has a plurality of sides 32, such as four, for example, forming a substantially rectangular cross-sectional shape. However, it is understood the base 14 can have any number of sides forming other cross-sectional shapes such as triangular, hexagonal, any other polygonal shape as desired. Additionally, the sides 32 can form a L-shaped cross-sectional shape, a V-shaped cross-section shape, a T-shaped cross-sectional shape, or any other angled cross-sectional shape. In another example, the first portion 12 can have one continuous side forming a circular, ovular, or other curvilinear shapes. The base 14 has a length and width substantially equal to a length and width of the first portion 12. For example, the first portion 12 and the base 14 may have a width substantially equal to 5.5 inches and a length substantially equal to 2.5 inches or a width equal to 4 inches and a length equal to 4 inches. As a result, the outer dimensions or perimeter of the base 14 is equal to the outer dimensions or perimeter for the first portion 12. However, the base 14 and the first portion 12 can have any width and length as desired equal to each other or unequal from each other.

The height of the first portion 12 can be any height as desired configured to support the cross-members of the fence or the objects the post assembly 10 is configured to support. For example, for a split-fence assembly, the first portion may have a height of 54 inches to receive three cross-members. The height of the base 14 is configured to provide sufficient support for the first portion 12 and cross-members or the object being supported by the post assembly 10. For example, when the height of the first portion 12 is 54 inches, the height of the base 14 is 30 inches. However, any other heights of the first portion 12 and the base 14 can be contemplated without departing from the scope of the disclosure.

The receptacle 28 can be a black or grey color or a color to match the first portion 12 of the post assembly 10. However, the receptacle 28 can be any color as desired. Additionally, the receptacle 28 can include indicia 34 disposed or formed on an outer surface thereof. The indicia 34 can be a visual marking, such as a line marking, with numerals or letters to indicate a depth in which the base 14 is to be positioned below a stabilizing surface 36 which will be further described hereinbelow. For example, the indicia 34 may be positioned a distance from an upper end of the receptacle 28 adjacent the first portion 12 such as 1 inch from the upper end of the receptacle 28.

The receptacle 28 is divided into a pair of compartments 38 by a dividing wall 40 extending along the height of the receptacle 28 and between opposing sides of the receptacle 28. The wall 40 is configured to increase a rigidity and strength of the receptacle 28. The receptacle 28 is formed from a unitary integrally formed unit. However, the receptacle 28 can be formed from multiple separately formed units that are coupled together to form the receptacle 28.

According to one embodiment of the disclosure, the filler 30 is formed from a rigid material such as a rigid spray foam material. For example, the filler 30 can be a two-component polyurethane spray foam or other liquid plastic spray foam. The filler 30 has a minimum compression strength of 217 kilopascal (kPa) or 31.5 pounds per square inch (psi). According to another embodiment of the disclosure, the filler 30 is formed from a concrete material. The filler 30 is received in bother compartments 38.

The coupling device 26 is a plurality of elongate inserts 42. As illustrated the inserts 42 are elongate cylindrical inserts formed from a steel material such as reinforcing bars. A first portion of the inserts 42 are received by the base 14 and extend at a distance from the upper end of the receptacle 28. The inserts 42 are secured n and embedded in the receptacle 28 by the filler 30, wherein a movement of the inserts is militated against. A second portion of the inserts 42 are received in bores 44 formed in the upper portion 12. The inserts 42 may be maintained within the upper portion 12 by an interference fit, for example. The inserts 42 can include a plurality of ribs formed thereon to facilitate securement with the filler 30 of the base 14 and with the upper portion 12.

In the embodiment illustrated, three of the inserts 42 are employed to couple the base 14 to the upper portion 12. However, more than three or fewer than three of the inserts 42 can be employed as desired. The inserts 42 are staggered with respect to each other, wherein at least a portion of the inserts 42 do no align with each other with respect to the width of the base 14 or the length of the base 14. However, the inserts 42 can align with each other with respect to the width of the base 14 or the length of the base 14. The staggering of the inserts 42 facilitates stabilization of the first portion 12 and militates against racking of the first portion 12. The inserts 42 are positioned substantially parallel to each other in a height direction of the base 14.

A seal 46 such as a capillary gasket, for example, is disposed between the first portion 12 and the base 14. As a result, leaking is prevented from transferring between the first portion 12 and the base 14. Moisture can be prevented from transferring between the portions 12, 14.

The base 14 is configured for positioning beneath the stabilizing surface 36. The stabilizing surface 36 may be a ground for example such as soil or dirt or other surface for placing the post assembly 10 or positioning fences. A majority of the base 14 is positioned beneath the stabilizing surface 36 in a hole formed to receive the base 14 which is backfilled after the hole receives the base 14. A small portion of the base 14 is exposed outside of the stabilizing surface 36. The entirety of the first portion 12 is exposed outside of the stabilizing surface. As a result, when repairing the post assembly 10, only the first portion 12 is required to be replaced. The small portion of the base 14 exposed outside of the surface 36 assists a person in visually identifying the base 14 for replacement of the first portion 12.

To assemble the post assembly 10, compartments 38 of the receptacle 28 are filled with the filler 30. The first portion of the inserts 42 are positioned within the receptacle 28 within the filler 30. It is understood, the inserts 42 can be positioned within the receptacle 28 before or after the filling of the filler 30 depending on the type of material being used as the filler 30. The hole is formed or dug in the stabilizing surface 36, such as in a ground, dirt, or soil, to receive the base 14. The base 14 is positioned in the hole so that the small portion of base 14 extends beyond the surface 36. The indicia 34 is employed by the person to assist in forming the hole with the depth indicated by the indicia. Once the base 14 is positioned in the hole, the hole is backfilled to cover the majority of and stabilize the base 14. The base 14 can then remain beneath the surface 36 without having to remove the base 14 for future maintenance.

The bores 44 are formed in the second end 22 of the first portion 14 to receive the second portion of the inserts 42. The number of and positioning of the bores 44 correspond to the number of and positioning of the inserts 42. The seal 46 is positioned between the first portion 12 and the base 14. When the first portion 12 requires replacement or repairs, the first portion 12 is decoupled from the base 14 and can be replaced with a new one of the first portion 12 or a refurbished one of the first portion.

Advantageously, a portion of the post assembly 10 can be replaced without having to dig up or otherwise open up the hole to remove the base 14. Because the base 14 is formed from a durable material, the base 14 does not have to be replaced as often as the first portion 12. As a result, destruction of landscaping can be minimized, efficiency is maximized, repairs are ergonomically optimized, and costs are reduced when repairing or replacing portions of the post assemblies. Furthermore, the structural integrity of the post assembly is maintained.

From the foregoing description, one ordinarily skilled in the art can easily ascertain the essential characteristics of this invention and, without departing from the spirit and scope thereof, can make various changes and modifications to the invention to adapt it to various usages and conditions.

I claim:

1. A post assembly comprising:

an elongate first portion having a upper first end and an opposing lower second end, the elongate first portion configured for supporting a structure;

a second portion formed from a plastic material coupled to the opposing lower second end of the elongate first portion; and a coupling device coupling the elongate first portion to the second portion, the coupling device including a plurality of elongate inserts, wherein a first segment of the plurality of elongate inserts is received in the second portion of the post assembly and a second segment of the plurality of elongate inserts is received in the opposing lower second end of the elongate first portion of the post assembly, the plurality of elongate inserts extending longitudinally in a length direction of the elongate first portion and the second portion, and wherein a cross-section between the upper first end and the opposing lower second end of the elongate first portion is constant.

2. The post assembly of claim 1, wherein the second portion is a base configured for disposal beneath a stabilizing surface.

3. The post assembly of claim 1, wherein the second portion includes a receptacle and a filler.

4. The post assembly of claim 3, wherein the receptacle is divided into a pair of compartments by a dividing wall.

5. The post assembly of claim 3, wherein the receptacle is formed from a plastic material.

6. The post assembly of claim 5, wherein the receptacle is formed from a polyethylene plastic material.

7. The post assembly of claim 3, wherein the receptacle is formed a metal.

8. The post assembly of claim 3, wherein the filler is a plastic spray foam.

9. The post assembly of claim 8, wherein the filler is a two-component polyurethane spray foam.

10. The post assembly of claim 3, wherein the filler is a cement.

11. The post assembly of claim 1, wherein the plurality of elongate inserts are staggered.

12. The post assembly of claim 1, wherein the first portion is formed from a wood.

13. A post assembly configured for disposing in a ground comprising:

an elongate upper portion having an upper first end and an opposing lower second end, the elongate upper portion exposed from the ground;

a base portion formed from a plastic material removeably coupled to the opposing lower second end of the elongate upper portion, at least a portion of the base portion disposed in the ground; and a plurality of elongate insert inserts coupling the elongate upper portion to the base portion, wherein a first portion of the plurality of elongate inserts is received in the base portion and a second portion of the plurality of elongate inserts is received in the opposing lower second end of the elongate upper portion, the plurality of elongate inserts extending longitudinally in a length direction of the elongate upper portion and the base portion, and wherein the elongate upper portion has a constant cross-section between the upper first end of the elongate upper portion and the opposing lower second end of the elongate upper portion.

14. The post assembly of claim 13, wherein the upper portion is formed from a wood.

15. The post assembly of claim 13, wherein the base portion includes a receptacle and a filler disposed in the receptacle, the receptacle formed from a plastic and the filler is one of a plastic foam and a cement.

16. The post assembly of claim 15, wherein the first portion of the plurality of elongate inserts is embedded in the filler.

17. The post assembly of claim 13, wherein a portion of the base portion is exposed from the ground, and wherein the base portion includes indicia formed on an outer surface thereof visually indicating the portion of the base portion permissible to be exposed from the ground.

18. The post assembly of claim 13, wherein a seal is disposed between the elongate upper portion and the base portion.

19. A method for installing a post assembly in a ground comprising the steps of:

forming a hole in the ground;

providing a receptacle formed from a plastic;

positioning a plurality of inserts in the receptacle;

embedding the plurality of inserts into the receptacle with a plastic foam, the plastic foam and the receptacle forming a base portion of the post assembly, wherein the plurality of inserts extend longitudinally in a length direction of the base portion;

providing an upper portion to be coupled with the base portion of the post assembly, wherein the upper portion has a constant cross-section from an upper first end to a second lower end thereof;

forming bores in the upper portion aligning with the plurality of inserts extending from the base portion; and placing the upper portion against the base portion, wherein the plurality of inserts extend into the lower second end of the upper portion longitudinally in a length direction of the upper portion.

* * * * *